US006925675B1

(12) United States Patent
Trunecek

(10) Patent No.: US 6,925,675 B1
(45) Date of Patent: Aug. 9, 2005

(54) THERMAL ICE SCRAPER

(76) Inventor: Scott D. Trunecek, 1450 S. Webb, No. 221, Wichita, KS (US) 67207

( * ) Notice: Subject to any disclaimer, the term of this patent is extended or adjusted under 35 U.S.C. 154(b) by 0 days.

(21) Appl. No.: 10/776,723

(22) Filed: Feb. 11, 2004

(51) Int. Cl.[7] ..... A47L 13/02; H05B 3/20

(52) U.S. Cl. ..... 15/236.02; 15/236.01; 219/227

(58) Field of Search ..... 15/236.01, 236.02, 15/236.05, 236.08, 236.07; 30/169; 219/227, 219/203

(56) References Cited

U.S. PATENT DOCUMENTS

| | | | | |
|---|---|---|---|---|
| 2,171,606 A | * | 9/1939 | Shultz | 425/277 |
| 2,511,161 A | * | 6/1950 | Hammond | 30/140 |
| 3,711,679 A | | 1/1973 | Moschkau et al. | |
| 3,935,425 A | | 1/1976 | Weissberger et al. | |
| 4,719,660 A | * | 1/1988 | Hopkins | 15/105 |
| 4,930,176 A | | 6/1990 | Gelman | |
| 5,287,593 A | | 2/1994 | Spruger | |
| 5,357,646 A | | 10/1994 | Kim | |
| 5,369,257 A | | 11/1994 | Gibbon | |
| 5,837,296 A | * | 11/1998 | Virkler | 425/277 |
| 5,973,294 A | | 10/1999 | Schatt et al. | |
| 6,283,656 B1 | | 9/2001 | Jiang | |

OTHER PUBLICATIONS

"Hot Ice Scraper" http://www.shopsolution.co.uk/gemstore/detail.asp?prod_ID=111 copyright 2000.*

* cited by examiner

*Primary Examiner*—John Kim
*Assistant Examiner*—Laura C Cole
(74) *Attorney, Agent, or Firm*—Dale J. Ream

(57) ABSTRACT

A thermal ice scraper includes a body portion, a blade portion, and a heatable material in the body portion that can heat the edges of the blade portion. The body and blade portions may be permanently or removably attached, and a conductive element may be included to aid in transferring heat to the edges of the blade portion. When in use, the body portion is heated in a microwave oven, causing the heatable material to become hot. This heat is then transferred to the edges of the blade portion. The thermal ice scraper is held in a hand and used to scrape a smooth surface, such as an automobile windshield. The blade portion allows multi-directional usage of the scraper, and the heat along the edges of the blade portion facilitates the removal of frost, ice, or snow. The body portion comfortably accommodates the hand.

13 Claims, 6 Drawing Sheets

110
150
120a
232
233
231
230
232
233
232
233
120b
200

232
233
231
110
2c
120
2c
200

110
150
120
2d
230
200

150
110
120

THERMAL ICE SCRAPER

BACKGROUND OF THE INVENTION

This invention relates generally to windshield ice scrapers and, more particularly, to a thermal ice scraper that may be heated in a microwave oven to facilitate the removal of frost, ice, or snow from a smooth surface such as an automobile windshield.

The standard method of removing ice and frost from automobile windshields involves chipping away at the ice with a flat plastic ice scraper that is difficult to hold and ineffective on thick ice. Many people use a de-icing spray to weaken the ice, but this can be expensive and sometimes messy. There is a very high demand for new and innovative means of removing ice and frost from automobile windshields, and car owners everywhere would welcome any improvement made to the standard ice scraper.

Some improved models, however, have other drawbacks. Electric heated ice scrapers are known in the art, such as in U.S. Pat. No. 3,711,679, U.S. Pat. No. 3,935,425, and U.S. Pat. No. 4,930,176, but they require electricity from the automobile, are sometimes difficult or cumbersome to use, and are often expensive. Other electric heated ice scrapers are battery operated, such as in U.S. Pat. No. 5,357,646, but batteries are expensive and can leak, which causes safety concerns and can potentially ruin the scrapers. Additionally, other products that improve upon the standard ice scraper by adding features such as a snow brush or a squeegee are usually too large to conveniently store in the vehicle, too expensive, or simply not useful.

Microwave ovens offer a fast and easy way to heat materials that can be used to supply heat to another object. In general, these materials are either a gel or another moist substance that contains some water and retains heat. Popular uses for such materials include hot packs for muscle pain relief and for keeping food warm. U.S. Pat. No. 5,369,257 uses a microwave-heatable material placed directly on a windshield to defrost the windshield, but it has poor scraping characteristics; when its material cools off from use, it must be reheated in the microwave to continue clearing the windshield.

Therefore, it is desirable to have an ice scraper that transfers heat to windshields to aid in snow and ice removal, is heated in microwave ovens to provide its source of thermal energy, does not require electricity from automobiles or batteries, has good scraping characteristics, is comfortable and easy to use, can be conveniently stored in vehicles, and is relatively inexpensive.

SUMMARY OF THE INVENTION

A thermal ice scraper for use in cleaning frozen precipitation from automobile windshields according to the present invention includes a body portion, a blade portion, and a heatable material in the body portion that can heat the edges of the blade portion. When in use, the thermal ice scraper is heated in a microwave oven, causing the heatable material in the body portion to become hot and transfer heat to the edges of the blade portion. The thermal ice scraper is then held in a hand and used to scrape a smooth surface, such as an automobile windshield. The heat along the edges of the blade portion facilitates the removal of frost, ice, or snow while the body portion comfortably accommodates the hand and the blade portion allows multi-directional usage of the scraper. The body and blade portions may be permanently or removably attached, and a conductive element may be included to aid in transferring heat to the edges of the blade portion. The thermal ice scraper further includes a vacuum air space for insulating the body portion to keep the hand from being burned.

Therefore, a general object of this invention is to provide an ice scraper that can retain heat and transfer the heat to the edges of a blade portion to facilitate snow and ice removal.

Another object of this invention is to provide an ice scraper, as aforesaid, that does not require electricity from automobiles or batteries.

Still another object of this invention is to provide an ice scraper, as aforesaid, that can be heated in microwave ovens to provide a source of thermal energy.

Yet another object of this invention is to provide an ice scraper, as aforesaid, that has good scraping characteristics.

A further object of this invention is to provide an ice scraper, as aforesaid, that is ergonomic and easy to use.

A still further object of this invention is to provide an ice scraper, as aforesaid, that can be conveniently stored in vehicles.

Other objects and advantages of this invention will become apparent from the following description taken in connection with the accompanying drawings, wherein is set forth by way of illustration and example, embodiments of this invention.

DESCRIPTION OF THE PREFERRED EMBODIMENT

Figure 1A:
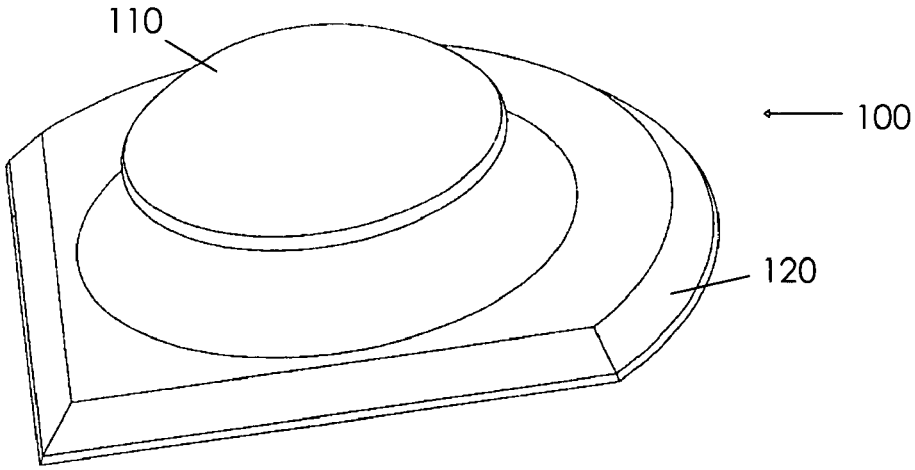
FIG. 1*a* is a front perspective view of a thermal ice scraper according to a now preferred embodiment of the present invention.
Figure 1B:
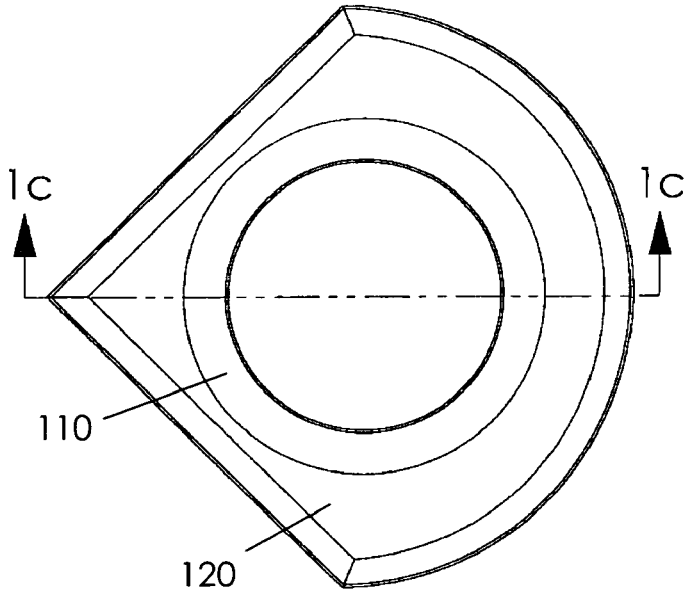
FIG. 1*b* is a top view of the thermal ice scraper as in FIG. 1*a;*
Figure 1C:
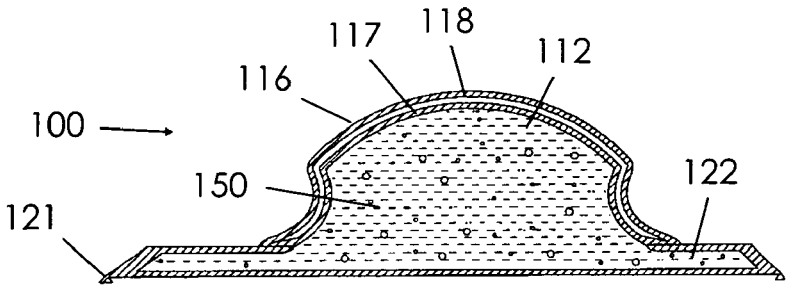
FIG. 1*c* is a sectional view taken along line 1*c*—1*c* of FIG. 1*b;*

A thermal ice scraper according to the present invention will now be described with reference to FIGS. 1*a* through 6*c* of the accompanying drawings. More particularly, a thermal ice scraper 100 according to a now preferred embodiment includes a body portion 110 fixedly attached to a blade portion 120 having at least one peripheral blade edge 121 (FIGS. 1*a*–1*c*). Thus, the body 110 and blade 120 portions have a monolithic construction although other removable configurations are possible as will be further described later. The body portion 110 defines a chamber 112 that is in communication with an interior space 122 defined by the blade portion 120.

A heatable material 150 is positioned in chamber 112 and interior space 122. The heatable material 150 is preferably a microwavable gel capable of fitting any shape and reaching very high temperatures quickly, but other moist substances that contain some water and retain heat would also be suitable, such as polymer crystals or various grains, pellets, and granulated materials that absorb some moisture and can be heated in a microwave. The heatable material 150 may be directly injected into the body portion 110 during manufacturing of the ice scraper 100, and a safety valve (not shown) may be necessary to prevent explosion if overheated.

The body portion 110 includes an outer wall 116 spaced apart from an inner wall 117 to create an intermediate space 118 (FIG. 1*c*). The intermediate space 118 is preferably a vacuum, which does not disrupt the method of microwave heating, provides an excellent insulating layer, and still allows some heat to reach the outer wall 116 to provide a desired hand-warming effect by radiating through the intermediate space 118 and by conducting up from the blade portion 120. Alternatively, conventional insulating material may be positioned in the intermediate space 118.

It is understood that both the body portion 110 and the blade portion 120 may utilize one of several ergonomic configurations. The shape of the body portion 110 determines how comfortable and easy to use the thermal ice scraper 100 is. The bell shape 110*a*, shown throughout the drawings and in FIG. 5*a* in particular, and the cylinder shape 110*b* (FIGS. 4*a* and 4*b*) have rounded tops that fit the palm of a hand well and allow the thermal ice scraper 100 to be used in any direction. The pistol grip shape 110*c* (FIGS. 4*c* and 4*d*) has the advantage of being at an angle that is nearly aligned with the bevel angle of the blade, making it much easier for the user to direct force for digging into the ice, and prevents the blade from skipping over the top. The tall, narrow shape of the pistol grip 110*c*, however, does not provide the best conditions for heat transfer, as some of the heat would be trapped near the top instead of moving down to the blade portion 120. Further, while the bell shape 110*a* and cylinder shape 110*b* may be used in any direction, the pistol grip shape 110*c* can only be held one way.

Figure 3A:
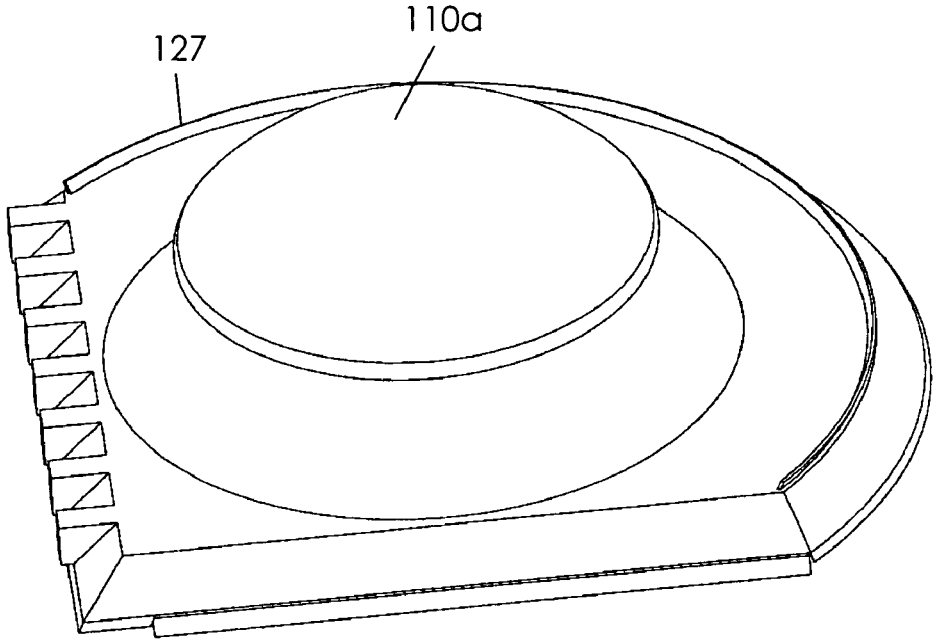
FIG. 3*a* is front perspective view of a thermal ice scraper according to still another embodiment of the present invention.
Figure 3B:
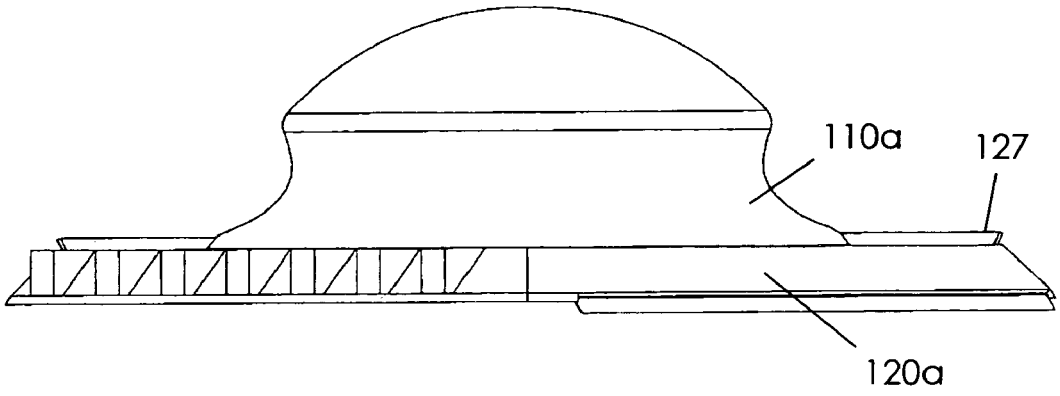
FIG. 3*b* is a front view of the thermal ice scraper as in FIG. 3*a;*
Figure 4A:
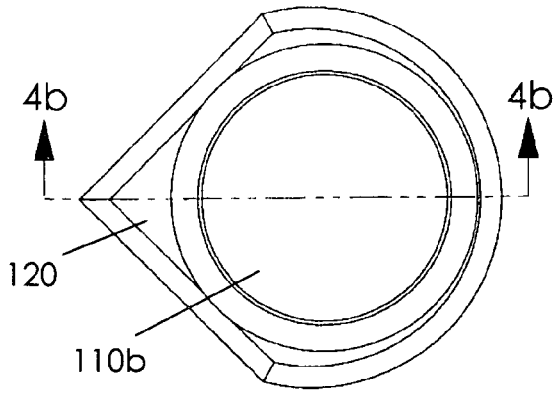
FIG. 4*a* is a top view of a thermal ice scraper according to yet another embodiment of the present invention.
Figure 4C:
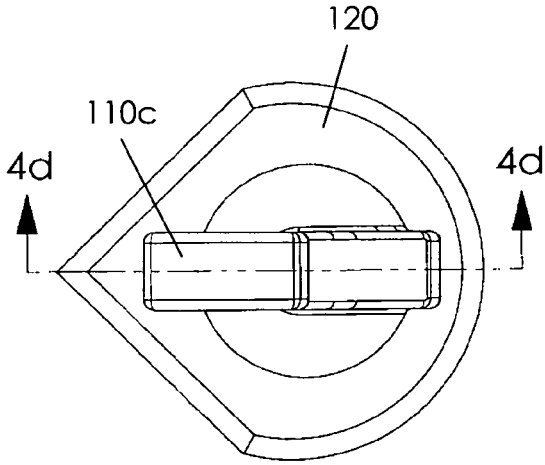
FIG. 4*c* is a top view of a thermal ice scraper according to a further embodiment of the present invention.
Figure 4B:
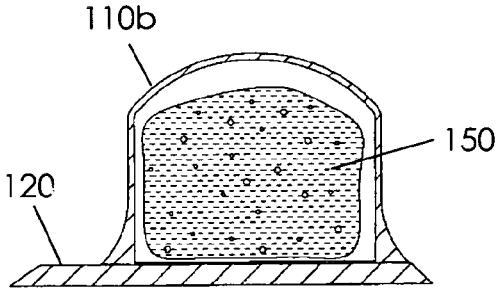
FIG. 4*b* is a sectional view taken along line 4*b*—4*b* of FIG. 4*a;*
Figure 4D:
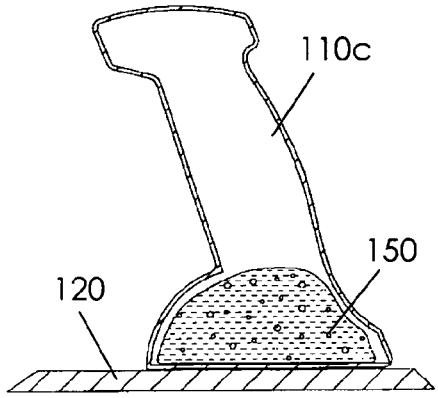
FIG. 4*d* is a sectional view taken along line 4*d*—4*d* of FIG. 4*c;*
Figure 5A:
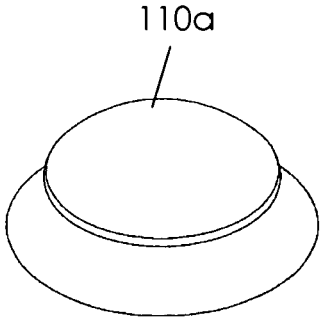
FIG. 5*a* is a front perspective view of a body portion according to an embodiment of the present invention.
Figure 5B:
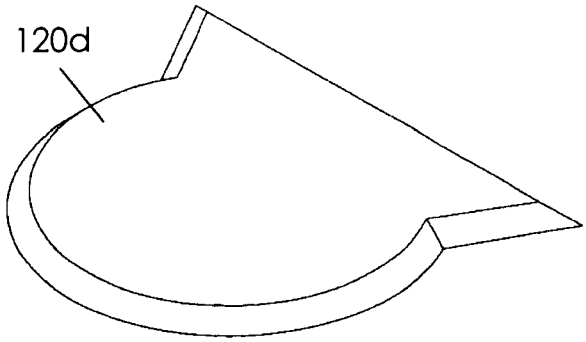
FIG. 5*b* is a front perspective view of a blade portion according to an embodiment of the present invention.
Figure 5C:
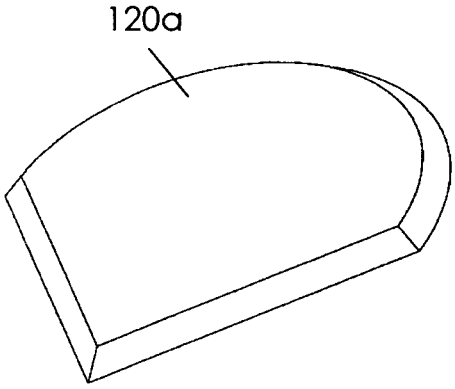
FIG. 5*c* is a front perspective view of a blade portion according to another embodiment of the present invention.
Figure 5D:
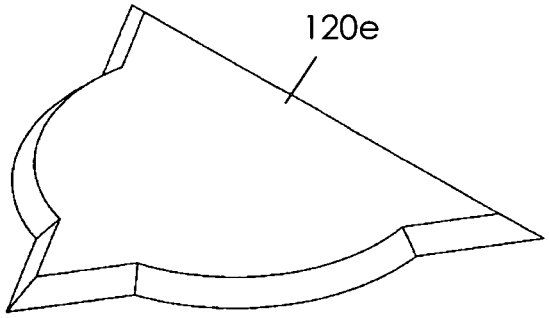
FIG. 5*d* is a front perspective view of a blade portion according to still another embodiment of the present invention.
Figure 5E:
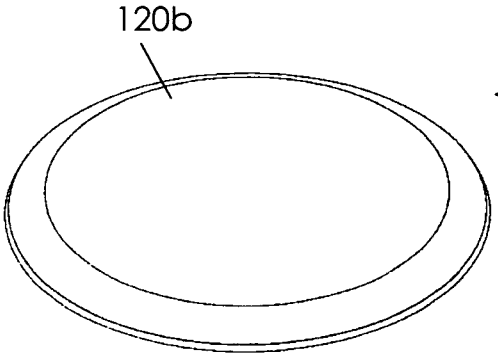
FIG. 5*e* is a front perspective view of a blade portion according to yet another embodiment of the present invention.
Figure 5F:
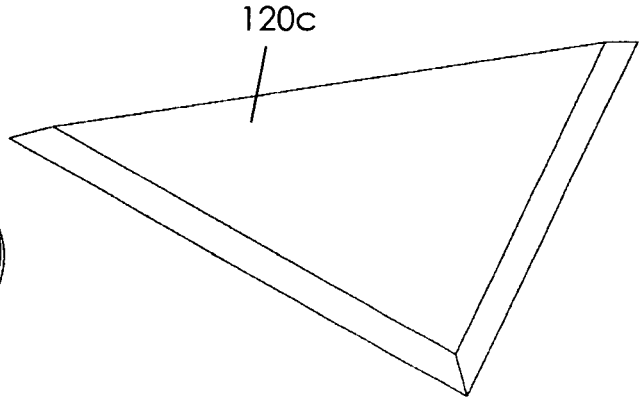
FIG. 5*f* is a front perspective view of a blade portion according to a further embodiment of the present invention.

The shape of the blade portion 120 largely determines the scraping characteristics of the thermal ice scraper 100. In general, the round shape 120*b* (FIG. 5*e*) has the advantage of working equally well in all directions. It also contacts the ice in a different way than a flat edge would; the initial contact is made at one point and spreads out as it gets under the ice. In some situations, this will cause the ice to be lifted up in large pieces rather than being smashed into small pieces as it usually is with a flat edge. Lip 127 may be added to the round blade 120*b* to help deflect and break ice during the aforementioned lifting (FIG. 3*a*). In many cases, however, having a flat edge or a wedge shape where two sides meet would be useful in chipping and splitting up ice. This is the main advantage of the triangular shape 120*c* (FIG. 5*f*). Another benefit of the triangular shape (or any multi-sided shape) is that each side could have a unique function. For example, one side could have teeth for breaking up thick ice while another side has a rubber squeegee for cleaning water and ice debris from the windshield. The flat, sharp edges of a triangle would also be useful in creating a hole in the ice to use as a starting point. A combination of the two 120*a*, shown throughout the drawings and in FIG. 5*c* in particular, is the preferred shape since it provides the multi-directional usage of the round blade 120*b* with the ice breaking benefits of the triangular blade 120*c*. The combination shape 120*a* may be outfitted with teeth on one flat edge and a squeegee or other alternative blade on the other flat edge (FIGS. 3*a* and 3*b*). The combination shapes 120*d* (FIG. 5*b*) and 120*e* (FIG. 5*d*) would also offer advantages of both the circular shape 120*b* and the triangular shape 120*c*.

The body portion 110 and blade portion 120 are preferably constructed of a durable plastic material that will not chip or crack during use or melt from the thermal loads imposed by the microwave oven and the heatable material 150, though other suitable materials may be used. Further, the body portion 110 and blade portion 120 may be a monolithic construction, and any combination of the body portion shapes and blade portion shapes listed above should be small enough to be conveniently stored in vehicles.

In use, the thermal ice scraper 100 is heated in a microwave oven, causing the heatable material 150 to become hot and transfer heat to the edges of the blade portion 120. The thermal ice scraper 100 is then held in a hand and used to scrape a smooth surface, such as an automobile windshield. The heat along the edges of the blade portion 120 facilitates the removal of frost, ice, or snow while the body portion 110 comfortably accommodates the hand and the blade portion 120 allows multi-directional usage of the scraper.

A thermal ice scraper 200 according to another embodiment of the present invention is shown in FIGS. 2*a* through 2*d* and includes a construction substantially similar to the construction previously described except as specifically noted below. More particularly, the thermal ice scraper 200 according to this embodiment includes a conductive element 230 to aid in transferring the heat from the heatable material 150 to the edges of the blade portion 120.

Figures 2A, 2B, 2C, 2D:
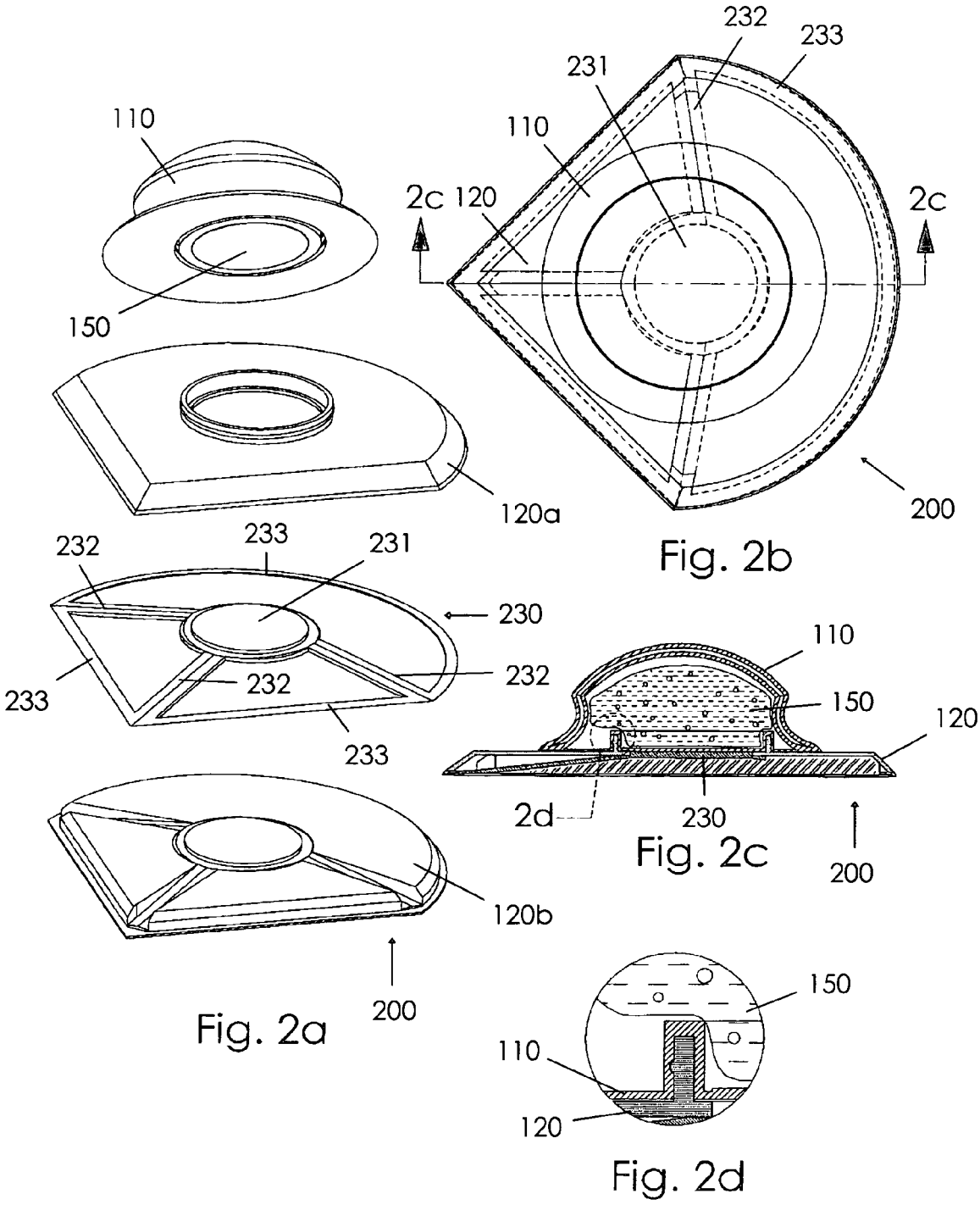
FIG. 2*a* is an exploded view of a thermal ice scraper according to another embodiment of the present invention.
FIG. 2*b* is a top view of the thermal ice scraper as in FIG. 2*a;*
FIG. 2*c* is a sectional view taken along line 2*c*—2*c* of FIG. 2*b;*
FIG. 2*d* is an isolated sectional view of a snap-type connection between a body portion and a blade portion of the thermal ice scraper as in FIG. 2*c;*

The conductive element 230 has a contact portion 231, at least one transfer portion 232, and a rim 233. The transfer portion 232 and rim 233 are positioned inside blade portion 120 and are sandwiched between an upper blade portion 120*a* and a lower blade portion 120*b*. The contact portion 231 is positioned to be in communication with the heatable material 150 when the body portion 110 and the blade portion 120 are connected. The body portion 110 and the blade portion 120 are preferably connected in a snap-fit connection (FIGS. 2*c* and 2*d*). Therefore, the body portion 110 is removably and releaseably coupled to the blade portion 120 (FIG. 2*a*).

In use, the body portion 110 is heated in a microwave oven, causing the heatable material 150 to become hot. The body portion 110 is then connected to the blade portion 120, causing the contact portion 231 to be in communication with the heatable material 150. The heat is then transferred down the transfer portion 232 to the rim 233, causing the edges of the blade portion 120 to become heated. For maximum heat transfer to the edges of the blade portion 120, the rim 233 would ideally be as close as possible to the outside surface of the blade portion 120. The conductive element 230 could be relatively thin and tightly sandwiched between the upper and lower blade portions 120*a* and 120*b* to insulate the interior portion of the blade portion 120 but allow heat to spread evenly on the outer edges of the blade portion 120, where the plastic is thinner and thus less insulative.

With the two-piece embodiment, multiple body portions 110 and blade portions 120 with shapes as discussed above may be combined to take advantage of different features for different scraping conditions. The heated body portion 110 may also be utilized as a warming device (such as a pocketsize hand warmer) when not connected to the blade, though this may require an additional component to cover the heatable material 150 and make the device safe for use. The two-piece embodiment also allows the heatable material 150 to consist of injected materials as discussed above or a removable gel pack. The removable gel pack could be conventional or sodium-acetate, which would allow the pack to be heated without a microwave for its first use.

Figure 6A:
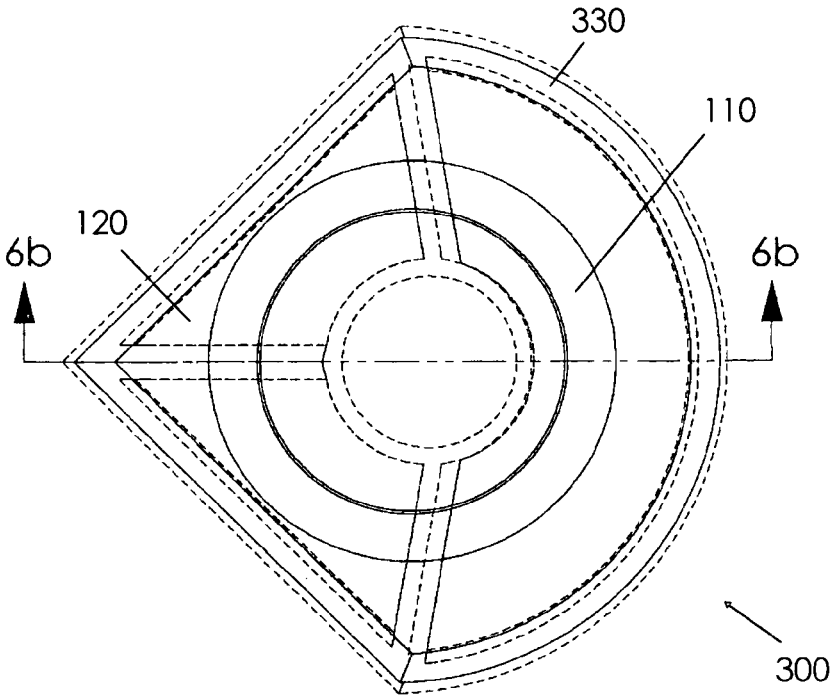
FIG. 6*a* is a top view of a thermal ice scraper according to a still further embodiment of the present invention.
Figure 6B:
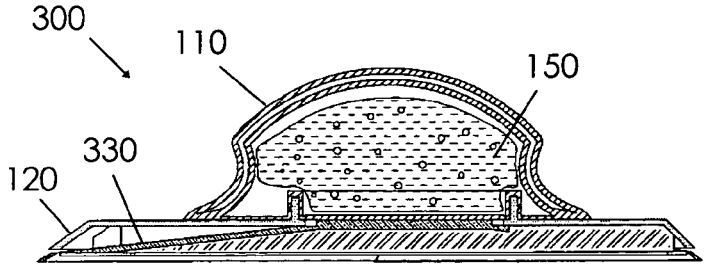
FIG. 6*b* is a sectional view taken along line 6*b*—6*b* of FIG. 6*a*.
Figure 6C:
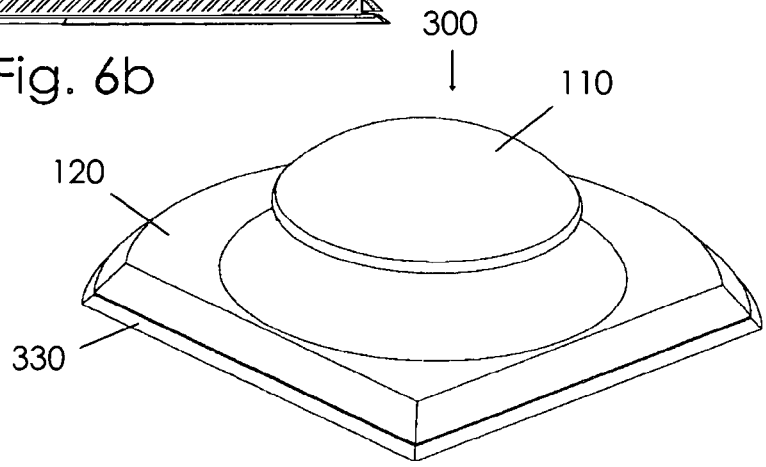
FIG. 6*c* is a front perspective view of the thermal ice scraper as in FIG. 6*a*.

A thermal ice scraper 300 according to still another embodiment of the present invention is shown in FIGS. 6*a* through 6*c* and includes a construction substantially similar to the construction previously described except as specifically noted below. More particularly, the thermal ice scraper 300 according to this embodiment includes a conductive element 330 that acts as the scraping blade and transfers the heat from the heatable material 150 to the surface being cleaned. The conductive element 330 should be made of a conductive material that can be used on glass without scratching the surface of the glass being cleaned. Brass is one metal that is capable of this because its hardness (a measure of how much energy is required to dent a material) is much less than that of glass. Brass is also an excellent conductor of heat and is currently the preferred material for this embodiment of the present invention although bronze or copper are other metals with similar characteristics. This method would be the most direct way to apply the heat to the ice as it is being scraped.

A thermal ice scraper (not shown) according to yet another embodiment of the present invention includes a construction substantially similar to the construction previously described except as specifically noted below. More particularly, the thermal ice scraper according to this embodiment includes a temperature indicator on the outside of the thermal ice scraper to show when it is hot, warm, or cold. This will let the user know if the product has reached the proper operating temperature and could be many substances, including stick-on temperature indicators similar to those found on aquariums.

It is understood that while certain forms of this invention have been illustrated and described, it is not limited thereto except insofar as such limitations are included in the following claims and allowable functional equivalents thereof.

What is claimed is:

1. A heatable ice scraping apparatus, comprising:

a body portion defining a chamber;

a blade portion connected to said body portion and defining an interior space in communication with said chamber, said blade portion having at least one peripheral blade edge;

a heatable material positioned in said chamber for temporarily storing thermal energy whereby to cause a heat transfer to said at least one peripheral blade edge;

a conductive element sandwiched between said body and blade portions for transferring said thermal energy from said heatable material to said peripheral blade edge;

wherein said conductive element is in communication with said heatable material; and wherein said conductive element extends beyond said at least one peripheral blade edge whereby to form a scraping blade.

2. The ice scraping apparatus as in claim 1 wherein said heatable material includes a microwavable gel.

3. The ice scraping apparatus as in claim 1 wherein said body portion and said blade portion include a monolithic construction.

4. The ice scraping apparatus as in claim 1 wherein said body portion includes:

an outer wall; and an inner wall spaced apart from said outer wall so as to define an intermediate space therebetween, said intermediate space being a vacuum.

5. The ice scraping apparatus as in claim 1 wherein said body portion includes:

an outer wall;

an inner wall spaced apart from said outer wall so as to define an intermediate space therebetween; and an insulating material in said intermediate space.

6. The ice scraping apparatus as in claim 1 wherein said body portion is releasably connected to said blade portion.

7. The ice scraping apparatus as in claim 1 wherein said blade portion includes a configuration that is round.

8. A heatable ice scraping apparatus, comprising:

a body portion defining a chamber and including a configuration for comfortably accommodating a person's hand, said body portion including an outer wall and an inner wall spaced apart from said outer wall so as to define an intermediate space therebetween, said space being a vacuum;

a blade portion connected to said body portion and defining an interior space in communication with said chamber, said blade portion having at least one peripheral blade edge; and a heatable material positioned in said chamber for temporarily storing thermal energy whereby to cause a heat transfer to said at least one peripheral blade edge, said heatable material including a moist substance that contains some water and retains heat.

9. The ice scraping apparatus as in claim 8 wherein said body portion and said blade portion include a monolithic construction.

10. The ice scraping apparatus as in claim 8 further comprising a conductive element sandwiched between said body and blade portions for transferring said thermal energy from said heatable material to said peripheral blade edge.

11. The ice scraping apparatus as in claim 8 wherein:

said body portion and said blade portion are removably connected;

said conductive element is in communication with said heatable material;

said conductive element is situated proximate to at least one outside surface of said at least one peripheral blade edge; and said conductive element is brass, bronze, or copper.

12. The ice scraping apparatus as in claim 8 wherein:

said body portion and said blade portion are removably connected;

said conductive element is in communication with said heatable material;

said conductive element extends beyond said at least one peripheral blade edge to act as a scraping blade; and said conductive element is a highly conductive that will not scratch glass.

13. The ice scraping apparatus as in claim 8 wherein said body portion and said blade portion are removably connected.

* * * * *